US005906104A

United States Patent [19]

Schwartz et al.

[11] Patent Number: 5,906,104

[45] Date of Patent: May 25, 1999

[54] COMBINATION AIR CONDITIONING SYSTEM AND WATER HEATER

[76] Inventors: Jay H. Schwartz, 14172 64th Dr. North, Palm Beach Gardens, Fla. 33418; Abraham Schwartz, 8580 Doverbrook Dr., Palm Beach Gardens, Fla. 33410

[21] Appl. No.: 08/941,686

[22] Filed: Sep. 30, 1997

[51] Int. Cl.[6] ..... F25B 27/00

[52] U.S. Cl. ..... 62/79; 62/238.6; 62/238.7; 237/2 B

[58] Field of Search ..... 62/238.6, 238.7, 62/160, 79; 237/2 B

[56] References Cited

U.S. PATENT DOCUMENTS

| | | | |
|---|---|---|---|
| 3,017,162 | 1/1962 | Haines et al. | 62/238.6 |
| 3,926,008 | 12/1975 | Webber | 62/238.6 |
| 4,409,796 | 10/1983 | Fisher | 62/238.7 |
| 4,646,537 | 3/1987 | Crawford | 62/238.7 |
| 4,955,207 | 9/1990 | Mink | 62/238.6 |
| 5,184,472 | 2/1993 | Guillbault et al. | 62/160 |
| 5,239,838 | 8/1993 | Tressler | 62/238.7 |
| 5,313,874 | 5/1994 | Lackstrom | 91/459 |
| 5,443,112 | 8/1995 | Scheideman | 165/1 |
| 5,495,723 | 3/1996 | MacDonald | 62/183 |
| 5,560,216 | 10/1996 | Holmes | 62/161 |
| 5,613,372 | 3/1997 | Beal et al. | 62/238.7 |
| 5,802,864 | 9/1998 | Yarbrough et al. | 62/238.6 |

*Primary Examiner*—William E. Tapolcai

[57] ABSTRACT

A heat transfer system including mechanical and electrical components for use with a mechanical air conditioning system to enable the system to efficiently reject heat to a water source, such as a pool or spa while simultaneously cooling an interior space. The air conditioning system incorporates three primary heat transfer coils in a mechanical refrigeration cycle to provide comfort cooling to an interior space while rejecting heat to either the atmosphere or a water source, such as a swimming pool. In an alternate heat pump embodiment, the system is capable of operating in an additional mode to absorb heat from the atmosphere and reject heat to the interior space.

16 Claims, 6 Drawing Sheets

COMBINATION AIR CONDITIONING SYSTEM AND WATER HEATER

BACKGROUND OF THE INVENTION

1. Field of the Invention

The present invention relates to mechanical heat transfer systems, such as air conditioning systems, and more particularly to a apparatus and method for converting an otherwise conventional residential or commercial air conditioning system into a heat transfer system capable of cooling an interior space while simultaneously heating a body of water, such as water from a swimming pool.

2. Description of the Background Art

Mechanical air conditioning and refrigeration systems, for absorbing heat from one source and rejecting heat to another source, are well known in the art. In a conventional mechanical air conditioning system, a pair of heat exchangers are fluidly connected in a refrigeration circuit through which a heat transfer medium (hereinafter "refrigerant") flows. In a typical system an evaporator coil is in heat transfer communication with interior space, and a condenser coil is in heat transfer communication with a suitable heat sink, such as ambient air from the atmosphere. Mechanical air conditioning systems are well known in the art. Such systems may be either "packaged," wherein all of the necessary components are packaged in a single unit, or "split systems," wherein typically the evaporator is remotely located with respect to the compressor and condenser.

Furthermore, the background art reveals heat transfer systems directed to rejecting heat into a water source, such as a swimming pool, to raise and maintain the temperature of the pool water at a comfortable level. The heat transfer systems of the background art recognize the efficiency of utilzing the waste heat of condensation, which would otherwise be rejected to the atmosphere without being put to any beneficial use, to heat water from a pool or spa for recreational purposes. In warm climates, the use of the swimming pool may be limited to those months where the ambient temperature is sufficient to warm the swimming pool water to a comfortable level, especially pools that are not exposed to direct sunlight. In colder climates, swimming pool water must be continually heated in order to provide comfortable aquatic recreation. In addition, there exists a number of other needs and uses for warmed water, including domestic hot water and water used for irrigation or other commercial purposes.

A number of references are directed to providing a mechanical system for rejecting heat to a water source. For example, U.S. Pat. No. 5,560,216, issued to Holmes, discloses a combination air conditioner and pool heater. U.S. Pat. No. 5,184,472, issued to Guilbault et al., discloses an add-on heat pump swimming pool control. U.S. Pat. No. 4,232,529, issued to Babbitt et al., discloses a mechanical refrigeration system for selectively heating swimming pool water. Babbitt et al. discloses three operating modes for selectively transferring heat. In the first mode, heat is transferred from the atmosphere to pool water. In a second mode, heat is transferred from a conditioned space to the atmosphere. In a third mode, heat is transferred from the conditioned space to pool water.

There are, however, a number of inherent disadvantages present in the prior art systems. Specifically, the prior art systems fail to disclose a system or method for routine modification of installed air conditioning systems for converting a straight cool system into a system capable of selectively heating pool water. Accordingly, there exists a need for a retrofit kit for mechanical air conditioning systems, for universal use with existing or new equipment, for converting the system to enable rejected heat to be used to warm pool water. Furthermore, additional energy savings would be realized if such a modification were capable of converting a straight cool air conditioning system into a heat pump such that the interior space served by the system could be efficiently heated, such that the energy savings of a heat pump were realized.

In addition, most mechanical air conditioning systems suffer from limitations in connection with the need to maintain an adequate supply of lubricating oil in the compressor. Specifically, oil used to lubricate the compressor is routinely carried by the refrigerant through the refrigerant lines. Furthermore, systems having hermetic compressors do not have a crankcase oil return connection and must rely on the refrigerant to return sufficient oil to the compressor. When the distance between certain components (e.g. evaporator and compressor) is substantial, care must be taken to insure the compressor is not starved for oil and that sufficient oil is returned to the compressor through the refrigerant lines. Accordingly, systems with heremetic compressors have historically been limited to applications having relatively short refrigerant line length requirements. As a result, it is recognized in the background art that hermetic compressors are prone to premature compressor failure in applications wherein the heat transfer coils are substantially spaced and connected by long refrigerant line runs. The oil return problem is most pronounced in complex heat transfer systems, such as those capable of rejecting heat to multiple sources, due to the spacing of components and existence of extended refrigerant line lengths. Accordingly, there exists a need for insuring that an adequate supply of lubricating oil is returned to a hermetic compresser in complex heat transfer systems.

A further disadvantage realized by most heat transfer systems results when oil, carried by refrigerant through the system, accumulates on the interior tube walls of the heat transfer coils and acts as a heat transfer insulator thereby degrading heat transfer efficiency. Accordingly, there exists a need for a mechanical air conditioning system capable of rejecting heat to a water source wherein heat transfer efficiency is maximized, and long runs of refrigerant tubing may be accommodated, by substantially eliminating the accumulation of lubricating oil from the heat transfer surfaces by separating entrained oil from compressed gas and returning the separated oil back to the compressor.

SUMMARY OF THE INVENTION

A heat transfer system including mechanical and electrical components for use in a mechanical air conditioning system to enable the system to efficiently utilize waste heat by rejecting the heat to a water source, such as a pool or spa, while simultaneously cooling and dehumidifying an interior space. The air conditioning system incorporates three primary heat transfer coils in a mechanical refrigeration cycle to provide comfort cooling to an interior space while rejecting heat to either the atmosphere or a water source, such as a swimming pool.

According to one embodiment of the present invention, a technician is able to convert a conventional air conditioning system by the addition of a few modular components. A first modular component contains refrigerant accessories, a second modular component contains a refrigerant-to-water heat exchanger and accessories, and a third modular component contains controls. Converting an existing air conditioning system merely requires the connection of each of the first two components in-line in the refrigerant piping network, and the electrical connection of the third component.

An air conditioning system according to the present invention includes the following primary mechanical heat transfer components: a refrigeration compressor; a first refrigerant-to-air heat transfer coil (hereinafter "evaporator") in heat transfer communication with an interior space; a second refrigerant-to-air heat transfer coil (hereinafter "condenser") in heat transfer communication with the atmosphere; and, a refrigerant-to-water heat exchanger in heat transfer communication with a water source. The system further incorporates controls for optimizing efficiency while maintaining pool water temperature at or near a desired set point.

A system according to the present invention is capable of the following two primary modes of operation. In the first mode of operation, the evaporator and condenser are active, and the refrigerant-to-water heat exchanger is inactive. In this mode, heat is absorbed from the interior space via the evaporator, and rejected to the atmosphere via the air cooled condenser. In the second mode of operation, the evaporator and the refrigerant-to-water heat exchanger are active, and the condenser is inactive. In this mode of operation, heat is absorbed from the interior space via the evaporator and rejected to water via the refrigerant-to-water heat exchanger.

In an alternate heat pump embodiment the system is further able to operate by absorbing heat from the atmosphere and rejecting heat to the interior space. In addition, other alternate embodiments provide for selective suction-liquid heat exchange to improve system efficiency and provide for refrigerant storage.

It is therefore an object of the present invention to provide a highly efficient heat transfer system.

A further object of the present invention is to provide a residential heat transfer system for cooling an interior residential space while heating pool water.

In accordance with these and other objects which will become apparent hereinafter, the instant invention will now be described with particular reference to the accompanying drawings.

DESCRIPTION OF THE PREFERRED EMBODIMENTS

Figure 1:
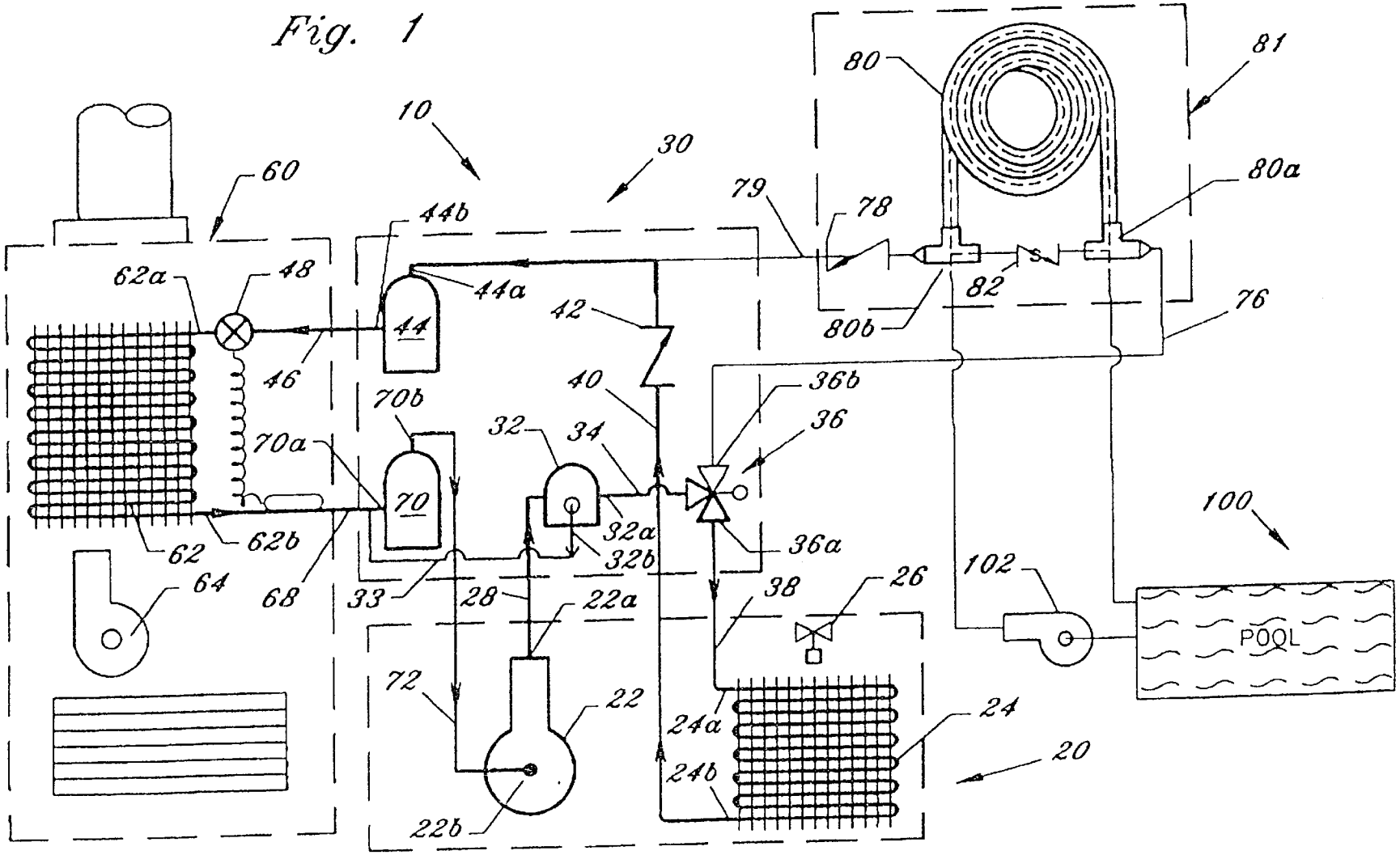
FIG. 1 is a schematic representation of a heat transfer system according to the present invention, wherein heat is rejected to the atmosphere.
Figure 2:
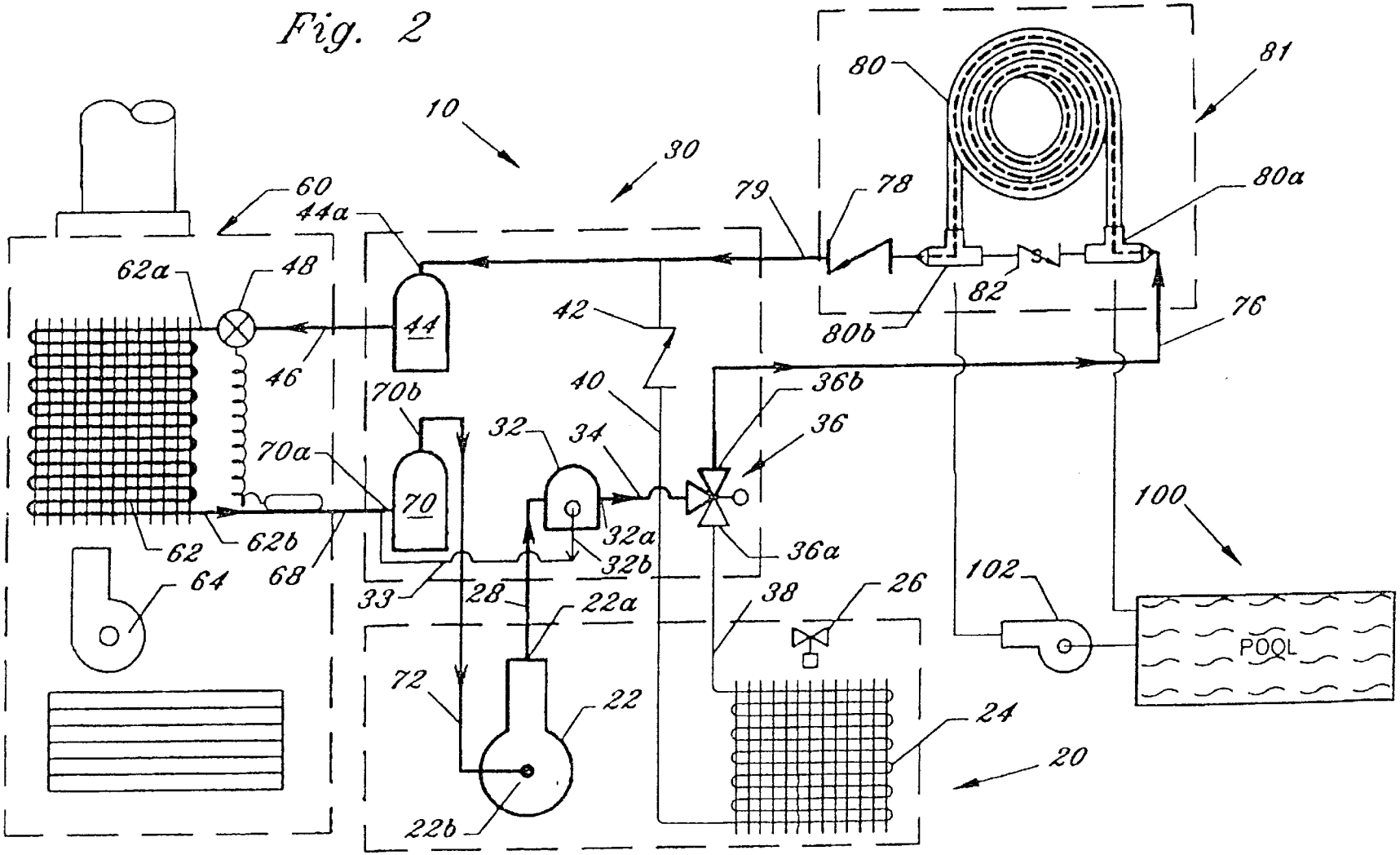
FIG. 2 is a schematic representation of a heat transfer system according to the present invention, wherein heat is rejected to water.

FIGS. 1 and 2 depict schematic representations of the preferred embodiment of a mechanical heat transfer system according to the present invention, generally referenced as 10, in each of the two primary operating modes. The system includes a condensing unit 20 having a compressor 22, and a condensing section consisting of a refrigerant-to-air heat transfer coil 24 and a fan 26. Condensing unit 20 may be a self contained condensing unit as normally found in a split system, or may comprise the compressor and condensing section of a packaged unit. Compressor 22 may be a compressor of any suitable type such as hermetic, reciprocating, rotary, scroll, screw, etc., and is preferably electrically powered. Compressor 22 includes a compressed gas output 22*a* in fluid communication, via refrigerant tubing 28, with an oil separator 32 contained within a first housing 30.

Oil separator 32 functions to separate substantially all of the oil entrained in the compressed refrigerant gas flowing from compressor 22. Oil separator 32 substantially reduces the amount of oil reaching the low side of the system (e.g. suction side) and helps maintain the oil charge in the compressor. Oil separator 32 includes a refrigerant output 32*a* fluidly connected via refrigerant tubing 34 to the input of a control valve 36, having a first outlet 36*a* and a second outlet 36*b*. Control valve 36 is preferably a heat reclaim valve, also known as a hot gas bypass valve, and is capable of selectively diverting compressed gas entering the valve inlet to either outlet 36*a* or 36*b*.

The first outlet 36*a* of valve 36 is fluidly connected via refrigerant tubing 38 to an inlet 24*a* of condenser 24. Condenser 24 further includes an output 24*b* which is fluidly connected, via refrigerant tubing 40 and check valve 42, to a liquid receiver 44 at receiver inlet 44*a*. Receiver 44 further includes a liquid refrigerant outlet 44*b* fluidly connected, via refrigerant tubing 46 and metering device 48, to an inlet 62*a* of evaporator coil 62 housed in air handling unit 60. In the preferred embodiment, schematically depicted in FIGS. 1 and 2, metering device 48 is a thermostatic expansion valve, however, the use of any suitable metering device, such as a capillary tube metering device, is considered within the scope of the invention. Air handling unit 60 is in heat transfer communication with an interior space and further includes a fan 64 for forcing air from the interior space across evaporator coil 62. Liquid refrigerant from receiver 44 is caused to expand within evaporator coil 62 and exits coil outlet 62*b* in a superheated vapor state.

Coil outlet 62*b* is fluidly connected, via refrigerant tubing 68 to a suction accumulator 70 at accumulator inlet 70*a*. As seen in FIG. 1, accumulator inlet 70*a* further communicates with an oil return outlet 32*b* via oil return line 33, whereby lubricating oil from oil separator 32 is mixed with refrigerant gas entering the accumulator and returned to the refrigerant gas stream returning to compressor 22 via accumulator 70. Accumulator 70 functions to prevent liquid refrigerant from returning to the compressor, and is fluidly connected, at outlet 70*b*, to the compressor suction inlet 22*b*, via refrigerant tubing 72.

Control valve 36 further includes an outlet 36*b* fluidly connected to a refrigerant-to-water heat exchanger, generally referenced as 80, at heat exchanger inlet 80*a*, via refrigerant tubing 76. In the preferred embodiment, refrigerant-to-water heat exchanger 80 comprises a coaxial tube heat exchanger having a corrosion resistant material, such as cupronickel or stainless steel, inner tube housed within an outer tube, such as a carbon steel jacket. As is apparent, however, any suitable heat exchanger material is considered within the scope of the invention. Heat exchanger 80 further communicates with a water source, such as a pool 100, whereby water is circulated through the heat exchanger 80, and specifically within the corrosion resistant inner tube, in heat transfer communication with refrigerant supplied by tubing 76, which refrigerant flows through the outer jacket. The refrigerant and water flow through heat exchanger 80 in counterflow so as to maximize the heat transfer efficiency.

As best depicted in FIG. 2, water from pool 100 flows through circulating pump 102 and enters heat exchanger 80 at 80*b*, whereafter a portion of the water flows through heat exchanger 80 while the remaining water flows through a pressure regulating by-pass valve 82. In the preferred embodiment, by-pass valve 82, compensates for pressure variations in inlet water pressure and maintains adequate water flow through heat exchanger 80 wherein the pool water is heated by refrigerant flowing from tubing 76. All of the pool water then exits the heat exchanger at 80*a* and returns to the pool as depicted in FIG. 2. Thereafter, condensed refrigerant exits heat exchanger 80 at 80*b* and travels through check valve 78 and refrigerant tubing 79 to the inlet 44*a* of liquid receiver 44.

The present invention contemplates that it may be desirable to configure the mechanical components referenced herein above in separate housings to facilitate an efficient installation. For example, the figures depict a first housing 30 containing oil separator 32, heat reclaim valve 36, check valve 42, receiver 44, accumulator 70, and associated refrigerant conduit. It is further contemplated that it is desirable to fill any remaining space within housing 30 with a suitable insulating foam (not shown) to prevent problems associated with condensation forming on various surfaces (e.g. external surfaces of accumulator 70). A second housing 81 may contain heat exchanger 80, bypass valve 82, liquid refrigerant check valve 78, and associated refrigerant and water conduit. Each housing has clearly marked refrigerant tubing and water connections for ease of installation. Accordingly, a technician is able to install components of the present invention using conventional refrigerant and water piping techniques.

I. First Operating Mode

In the first operating mode, wherein there is no demand for pool heat, evaporator coil 62 and condenser coil 24 are active, and the refrigerant-to-water heat exchanger 80 is inactive. In this mode, heat is absorbed from the interior space via the evaporator, and rejected to the atmosphere via the air cooled condenser coil. Specifically, as best depicted in FIG. 1, compressed refrigerant gas exits compressor 22 at 22*a* and passes through oil separator 32 wherein substantially all of the entrained oil is removed from the refrigerant. The refrigerant gas then flows to heat reclaim valve 36 which is configured to direct the refrigerant gas to valve outlet 36*a*. The refrigerant thus flows through condenser coil 24, wherein the refrigerant is condensed thereby rejecting heat to the atmosphere. The condensed refrigerant thereafter flows through tubing 40 and check valve 42 to liquid receiver 44. Liquid refrigerant exits receiver 44 and passes through metering device 48 and evaporator coil 62, wherein the liquid refrigerant evaporates thereby absorbing heat from the interior space. Refrigerant gas exiting the evaporator through tubing 68 mixes with oil from oil return line 33, enters accumulator 70 whereafter oil laden refrigerant gas return to the compressor 22 via suction line 72.

II. Second Operating Mode

In the second operating mode, wherein there is a demand for pool heat, evaporator 62 and heat exchanger 80 are active, and the condenser 24 is inactive. In this mode, heat is absorbed from the interior space via the evaporator, and rejected to the pool water via the refrigerant-to-water heat exchanger 80. Specifically, as best depicted in FIG. 2, compressed refrigerant gas exits compressor 22 at 22*a* and passes through oil separator 32 wherein substantially all of the entrained oil is removed from the refrigerant. The refrigerant gas then flows to control valve 36 which is configured to direct the refrigerant gas to valve outlet 36*b*. The refrigerant thus flows through heat exchanger 80, wherein the refrigerant is condensed thereby rejecting heat to the pool water flowing therethrough. The condensed refrigerant thereafter flows through check valve 78 and tubing 79 to liquid receiver 44. Liquid refrigerant exits receiver 44 and passes through metering device 48 and evaporator coil 62, wherein the liquid refrigerant evaporates thereby absorbing heat from the interior space. Refrigerant gas exiting the evaporator through tubing 68 mixes with oil from oil return line 33, enters accumulator 70 whereafter oil laden refrigerant gas return to the compressor 22 via suction line 72.

III. Alternate Embodiments

A. Suction-Liquid Heat Exchanger

Figure 3:
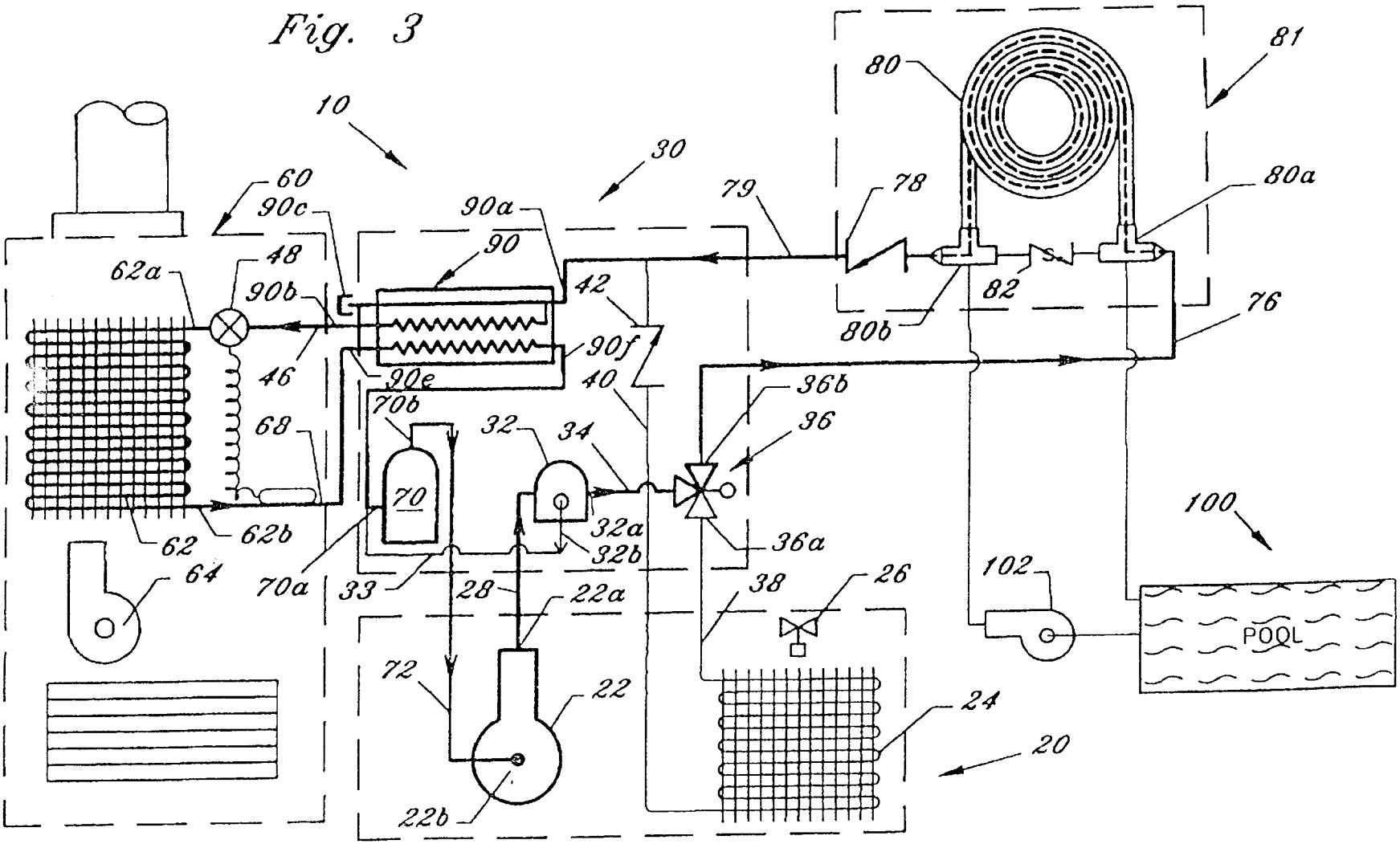
FIG. 3 is a schematic representation of an alternate embodiment of the present invention.

As seen in FIG. 3, the present invention contemplates an alternate embodiment wherein a suction-liquid heat exchanger, generally referenced as 90, is incorporated and the liquid receiver is eliminated. In this embodiment, the suction-liquid heat exchanger 90 is used to improve overall system efficiency and reduce condensation and exterior rust formation on the compressor.

Generally, suction-liquid heat exchangers subcool the liquid refrigerant and superheat the suction gas, thereby increasing the efficiency of the system and enabling the refrigerant to absorb a greater amount of heat in the evaporator coil and permitting the use of longer refrigerant liquid lines. In addition, the use of a suction-liquid heat exchanger provides sufficient liquid refrigerant storage capacity to allow for the elimination of the liquid receiver. In the alternate embodiment depicted in FIG. 3, a suction-liquid heat exchanger 90 is included in the confines of the first housing 30. The invention further contemplates that the suction-liquid heat exchanger will include a liquid inlet 90*a* and first and second liquid outlets, 90*b* and 90*c* respectively, in addition to a suction gas inlet 90*e* and outlet 90*f*.

According to the first alternate embodiment suction-liquid heat exchanger configuration, refrigerant vapor exiting the evaporator coil is routed through the suction-liquid heat exchanger by proper connection to the suction gas inlet 90*e* and the suction gas outlet 90*f*. Furthermore, liquid refrigerant (from either the condenser coil 24, or from heat exchanger 80) is supplied to the heat exchanger liquid inlet 90*a* via conduit 79. Thus, by connecting the first liquid outlet 90*b* to the refrigerant tubing 46 supplying the evaporator, and leaving the second liquid outlet 90*c* capped, the liquid and vapor refrigerant are brought into heat transfer communication and the liquid is subcooled. It has been found that liquid refrigerant, which has been subcooled using a suction-liquid heat exchanger, requires the insulation of the liquid line 46 from the first liquid outlet 90*b* to the metering device 48 to prevent condensation from forming on the liquid line. Accordingly, the first liquid outlet is utilized only when the liquid line 46 is either insulated or capable of being insulated in the field. On the other hand, by connecting the second liquid outlet 90*c* to the refrigerant tubing 46 supplying the evaporator 62, the liquid refrigerant vapor is not brought into direct heat transfer contact with the vapor refrigerant; however, the suction-liquid heat exchanger still provides a containment volume for storing liquid refrigerant thereby eliminating the need for a separate liquid receiver. As is apparent, the second liquid outlet 90*c* should be utilized when the liquid line is to remain uninsulated.

B. Alternate Suction-Liquid Heat Exchanger

Figure 4:
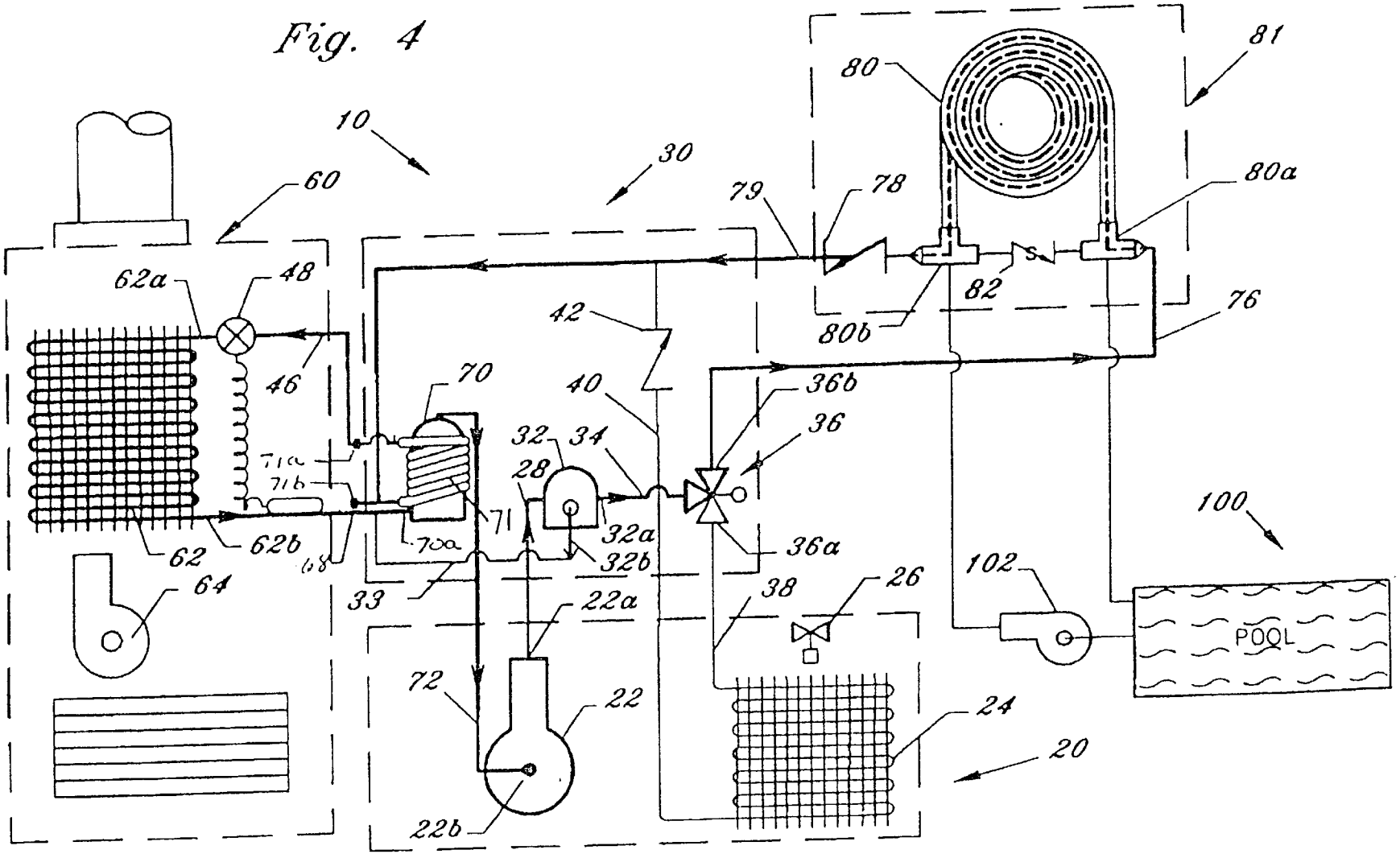
FIG. 4 is a schematic representation of another alternate embodiment of the present invention.

As best depicted in FIG. 4, the alternate embodiment includes an second structure for achieving the suction-liquid heat exchanger heat transfer effect. Specifically, the second alternate embodiment achieves the suction-liquid heat exchange by inclusion of a helical coil of copper refrigerant tubing 71 around the suction accumulator 70 and in heat transfer contact with the exterior surface thereof. Accordingly the suction-liquid heat exchanger heat transfer effect is achieved by routing liquid refrigerant through the helical coil 71 surrounding accumulator 70 whereby the liquid refrigerant is subcooled and the refrigerant vapor within the accumulator is superheated. As with the first alternate embodiment, the second alternate embodiment contemplates the use of both primary and secondary liquid outlet connections, 71*a* and 71*b* respectively. Connection of the primary liquid outlet 71*a* causes refrigerant to flow through the helical coil, while connection of the secondary liquid outlet 71*b* causes liquid refrigerant to substantially by-pass the helical coil; the helical coil however, remains available for storage of liquid refrigerant. Accordingly, the primary liquid outlet should be utilized only when the liquid line is either insulated or capable of being insulated in the field. On the other hand, by connecting the secondary liquid outlet to the refrigerant tubing supplying the evaporator, the liquid refrigerant vapor is not brought into direct heat transfer contact with the vapor refrigerant; however, the suction-liquid heat exchanger still provides a containment volume for storing liquid refrigerant thereby eliminating the need for a separate liquid receiver. As is apparent, the secondary liquid outlet should be utilized when the liquid line is to remain non-insulated.

C. Heat Pump Embodiment

Figure 5:
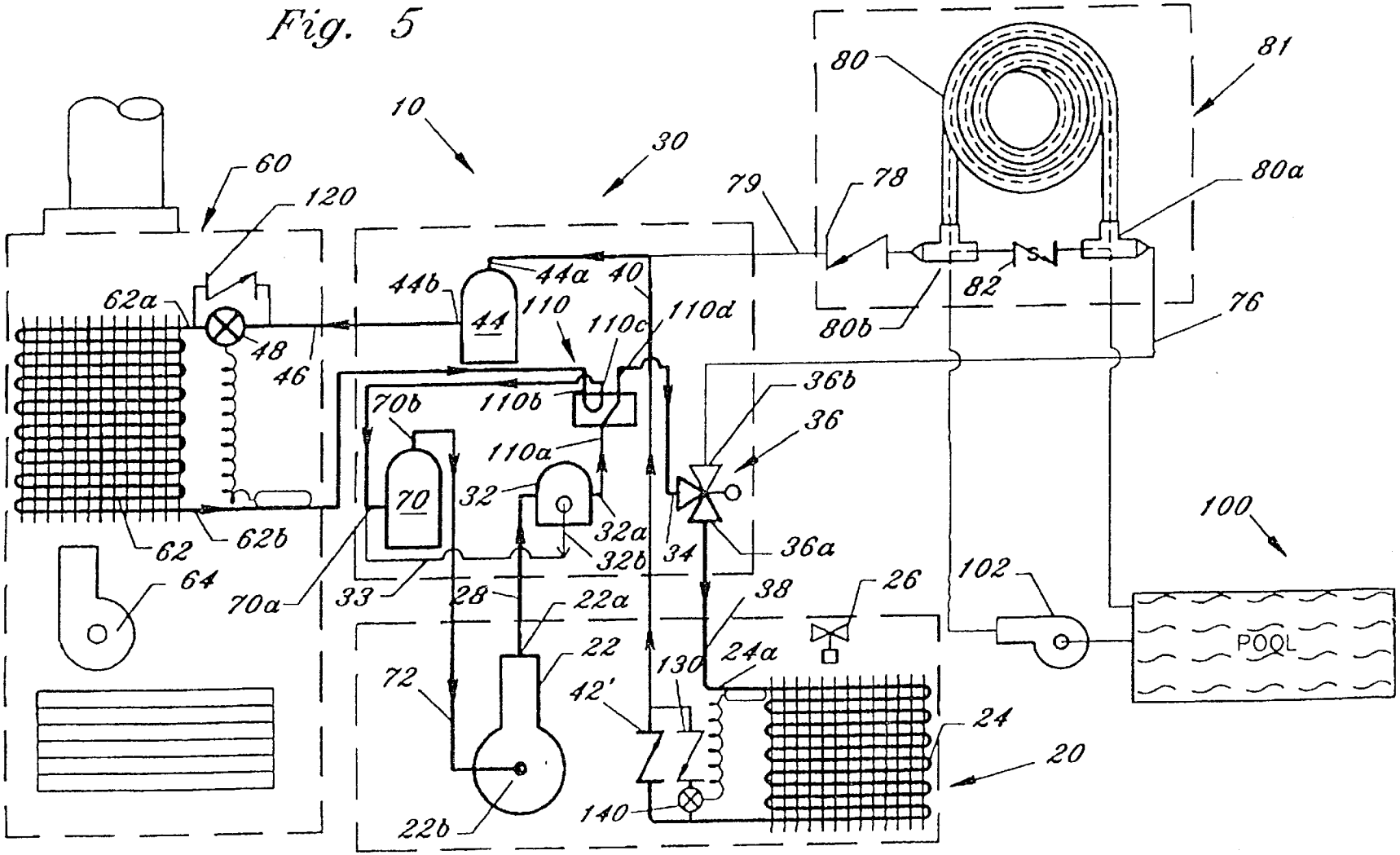
FIG. 5 is a schematic representation of the heat pump alternate embodiment in cooling mode.
Figure 6:
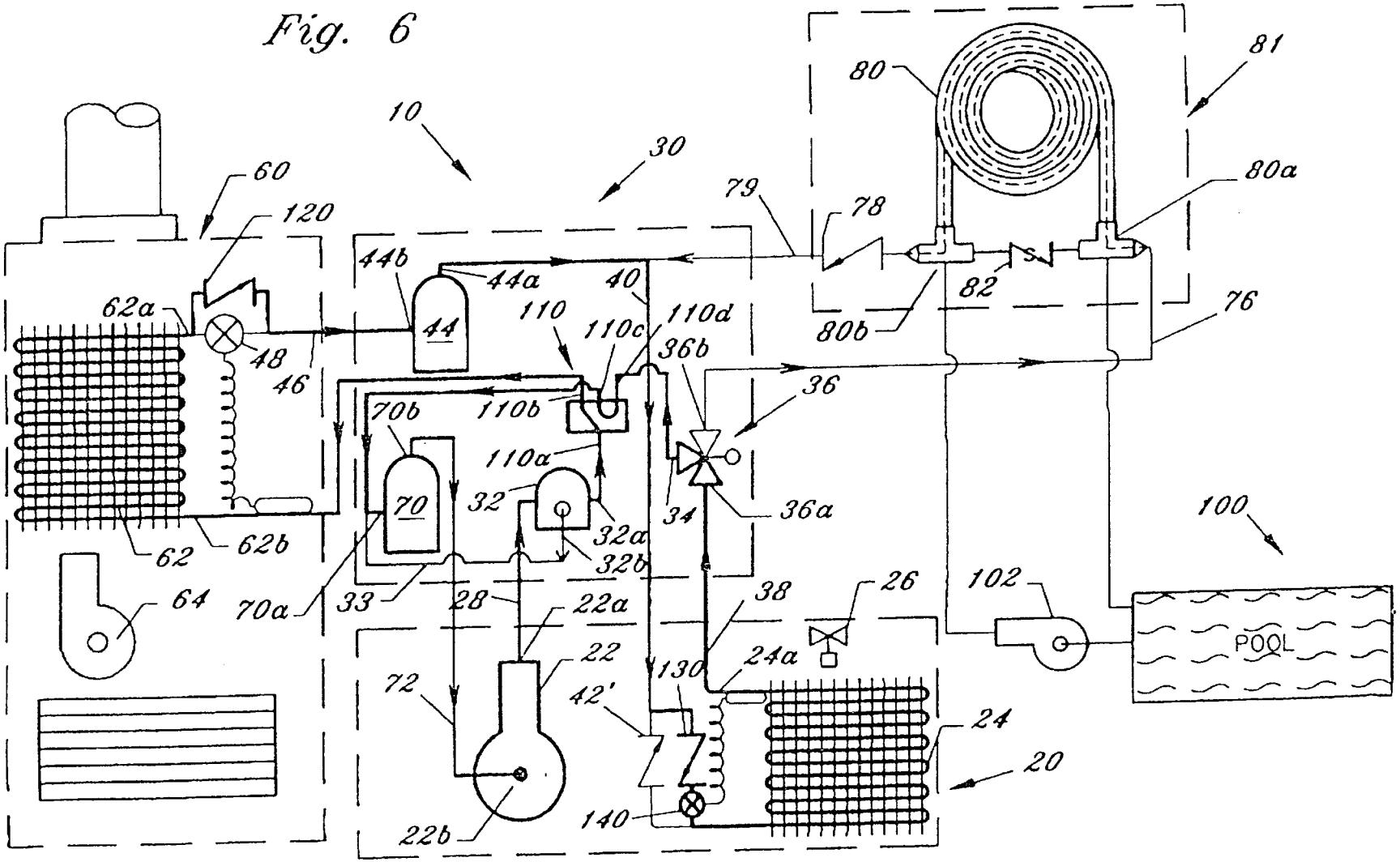
FIG. 6 is a schematic representation of the heat pump alternate embodiment in heating mode.

FIGS. 5 and 6 depict an alternate embodiment wherein the system is capable of functioning as a heat pump. Specifically, the embodiment shown in FIGS. 5 and 6 includes additional refrigeration accessories including a reversing valve 110. FIG. 5 depicts the alternate embodiment in a "cooling" mode, wherein coil 62 functions as an evaporator. This alternate embodiment includes all of the components disclosed in the preferred embodiment shown in FIG. 1. In addition, the following components are added: reversing valve 110, check valve 120, check valve 42', check valve 130 and metering device 140.

As best depicted in FIGS. 5 and 6, reversing valve 110 includes in inlet port 110*a*, and three outlet ports 110*b–d* respectively. Inlet 110*a* is fluidly connected to the oil separator outlet 32*a*. Reversing valve outlet 110*b* is fluidly connected to evaporator coil 62 at 62*b*, reversing valve outlet 110*c* is fluidly connected to accumulator inlet 70*a*, and reversing valve outlet 110*d* is fluidly connected to the inlet of control valve 36. Check valve 120 is fluidly connected in parallel with metering device 48. Check valve 130 and metering device 140 are fluidly connected in parallel with check valve 42'.

The cooling mode is depicted in FIG. 5. In the cooling mode, there is no demand for pool heat, evaporator coil 62 and condenser coil 24 are active, and the refrigerant-to-water heat exchanger 80 is inactive. In this mode, heat is absorbed from the interior space via the evaporator, and rejected to the atmosphere via the air cooled condenser coil. Specifically, as best depicted in FIG. 5, compressed refrigerant gas exits compressor 22 at 22*a* and passes through oil separator 32 wherein substantially all of the entrained oil is removed from the refrigerant. The refrigerant gas then flows to reversing valve inlet 110*a* which is in fluid communication with reversing valve outlet port 110*d* (note also the reversing valve ports 110*b* and 110*c* are in fluid communication). Accordingly, compressed refrigerant gas exits port 110*d* and is directed to heat reclaim valve 36 which is configured to direct the refrigerant gas to valve outlet 36*a*. The refrigerant thus flows through condenser coil 24, wherein the refrigerant is condensed thereby rejecting heat to the atmosphere. The condensed refrigerant thereafter flows through tubing 40 and check valve 42' to liquid receiver 44. Liquid refrigerant exits receiver 44 and passes through metering device 48 and evaporator coil 62 (note that check valve 120 prevents refrigerant from bypassing metering device 48), wherein the liquid refrigerant evaporates thereby absorbing heat from the interior space. Refrigerant gas exiting the evaporator through tubing 68, passes through reversing valve ports 110*c* and 110*b* respectively and is then routed to accumulator inlet 70 wherein it mixes with oil from oil return line 33, and enters accumulator 70 whereafter oil laden refrigerant gas return to the compressor 22 via suction line 72.

The heat pump heating mode is depicted in FIG. 6. In the heat pump heating mode, there is no demand for pool heat, but there is demand for heat in the interior space served by evaporator 62. Accordingly, in the heat pump heating mode evaporator 62 (functioning as a condenser) and condenser 24 (functioning as an evaporator) are active and heat exchanger 80 is inactive. In this mode, heat is absorbed from the atmosphere via condenser 24, and rejected to the interior space via evaporator 62. Specifically, as best depicted in FIG. 6, compressed refrigerant gas exits compressor 22 at 22*a* and passes through oil separator 32 wherein substantially all of the entrained oil is removed from the refrigerant. The refrigerant gas then flows to the reversing valve inlet 110*a* which communicates with outlet port 110*b*. Accordingly, the compressed refrigerant gas flows to evaporator coil outlet 62*b* (functioning as an inlet), through coil 62, wherein the compressed gas condenses to liquid, and exits the coil at 62*a* and bypasses metering device 48 via check valve 120. The liquid refrigerant then passes through receiver 44 and tubing 40 and bypasses check valve 42' via check valve 130 and metering device 140, whereafter the refrigerant passes through coil 24 and evaporates thereby absorbing heat from the atmosphere. The refrigerant gas then passes through control valve 36 and reversing valve ports 110*d* and 110*c* whereafter the refrigerant gas enters accumulator 70 at 70*a* on route to compressor suction inlet 22*b*.

As should be apparent, the heat pump embodiment may further incorporate the suction-liquid heat exchanger configurations disclosed herein.

IV. Control

The system includes a thermostat located in the interior spaced served by the air handling unit 60. The thermostat includes a temperature sensor (T-1) and an interior space set-point (SP-1) adjustment. In addition, heat exchanger 80 includes pool water inlet and outlet temperature sensors (T-2 and T-3 respectively), and the system provides for a user adjustable pool water set-point (SP-2). Furthermore, heat exchanger 80 incorporates a pressure differential switch (SW-1) connected across the heat exchanger water inlet and outlet. A refrigerant temperature sensor (T-4) is connected to refrigerant line 79 leaving heat exchanger 80.

Upon a demand for cooling of the interior space (e.g. T-1>SP-1), the following components are energized: evaporator fan 64, compressor 22, and condenser fan 26. In addition, pool pump 102 is energized so that a pool water temperature reading can be obtained by pool water inlet sensor T-2. If the pool water temperature is below set-point (e.g. T-2<SP-2), and pressure differential switch SW-1 detects a sufficient pressure differential across the pool water inlet and outlet, thereby indicating that there is sufficient pool water flow through heat exchanger 80, then condenser fan 26 is de-energized and hot gas by-pass valve 36 is energized thereby routing compressed refrigerant gas through heat exchanger 80 (e.g. pool heating mode). As should be apparent, de-energizing condener fan 26 results in substantial energy savings. Once the pool water reaches set-point (e.g. T-2≧SP-2), the condenser fan 26 is re-energized and control valve 36 is de-energized, thereby routing compressed refrigerant gas through condenser 24.

A. Alarm Conditions and Monitoring

SW-1 (normally open)—detects sufficient pool water flow. Prevents energizing of control valve 36 and de-energizing of condenser fan 26 if sufficient pool water flow is not detected.

T-2 (pool water inlet temperature sensor)—detects the temperature of the pool water entering the heat exchanger. If pool water inlet temperature is below 60° F. (adjustable) then the system is prevented from operating in the pool heating mode.

T-3 (pool water outlet temperature sensor)—detects the temperature of the pool water leaving the heat exchanger. If pool water outlet temperature is higher than 120° F. (adjustable) then the system is prevented from operating in the pool heating mode.

T-4 (refrigerant temperature sensor)—detects the temperature of the liquid refrigerant leaving the heat exchanger. If the refrigerant temperature is higher than 130° F. and the difference between the temperatures sensed by T-2 and T-3 is less than 10° F. fault light is illuminated indicating the need to clean the heat exchanger.

B. Energy conservation

The invention further contemplates control logic for tracking the amount of time during which pool pump 102 is energized during a 24 hour period. It is recognized that a typical pool pump should run approximately 8 hours per day to insure adequate water filtration. In a preferred embodiment, the invention will energize the pool pump to run in parallel with compressor 22. Under that control configuration, in the event that the compressor, and hence the pool pump, fails to accumulate a predetermined amount of run time (e.g. 8 hours) in a 24 hour period, the system will energize the pool pump sufficiently prior to the expiration of the 24 hour period to insure a full, e.g. 8 hours, of run time.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A heat transfer system for cooling an interior space and selectively rejecting heat to one of two alternate heat sinks, said system comprising:

(a) means for compressing refrigerant gas having a suction inlet and a compressed refrigerant gas outlet, said outlet in fluid communication with an oil separator, said oil separator having a refrigerant outlet in fluid communication with a control valve inlet, said oil separator further including an oil return outlet;

(b) said control valve further having first and second outlets, said control valve selectively movable from a first position wherein fluid communication is achieved between said control valve inlet and said control valve first outlet, and a second position wherein fluid communication is achieved between said control valve inlet and said control valve second outlet;

(c) a refrigerant-to-air heat transfer coil, said heat transfer coil including a fan, for forcing ambient air across said coil, and first and second refrigerant ports, for passing refrigerant fluid through said coil, said first refrigerant port in fluid communication with said control valve first outlet, and said second refrigerant port communicating with a first check valve;

(d) a refrigerant-to-water heat exchanger having a refrigerant inlet and outlet, a water inlet and outlet, and a water by-pass, said refrigerant inlet in fluid communication with said control valve second outlet, said heat exchanger refrigerant outlet in communication with a second check valve, said water inlet in fluid communication with water conduit and a water circulating pump for drawing water from a water source, said water outlet being in communication with a water conduit returning water to said water source;

(e) means for receiving refrigerant having an inlet and an outlet, said heat exchanger refrigerant outlet and said heat transfer coil second port being in fluid communication with said inlet of said means for receiving refrigerant via said first and second check valves respectively, said outlet of said means for receiving and storing refrigerant being in fluid communication with a refrigerant metering device;

(f) an evaporator having an inlet fluidly connected to said metering device, said evaporator in heat transfer communication with an interior space for allowing heat transfer between refrigerant flowing through said evaporator and air from the interior space, said evaporator further including an outlet and a fan for forcing air from an interior space across said evaporator;

(g) an accumulator having an inlet fluidly connected to said evaporator outlet, said accumulator inlet further being fluidly connected to said oil separator oil return outlet, said accumulator outlet fluidly connected to said compressor suction inlet;

(h) control means, responsive to interior space temperature and water temperature, for energizing and controlling said system for selectively cooling said interior space and selectively rejecting heat to said water source.

2. A heat transfer system according to claim 1, wherein said refrigerant-to-water heat exchanger comprises a coaxial tube heat exchanger having a corrosion resistant inner tube axially disposed within a tubular outer jacket.

3. A heat transfer system according to claim 2, wherein said refrigerant-to-water heat exchanger further includes means for by-passing a portion of water from said heat exchanger inlet to said heat exchanger outlet, said means for by-passing including a pressure compensating by-pass valve for compensating for pressure variations in inlet water pressure and maintaining adequate water flow through heat exchanger.

4. A heat transfer system according to claim 1, wherein said means for receiving refrigerant comprises a liquid receiver.

5. A heat transfer system according to claim 1, wherein said means for receiving refrigerant includes a suction-liquid heat exchanger.

6. A heat transfer system according to claim 1, wherein said means for receiving refrigerant includes a helical coil in heat transfer communication with said accumulator whereby liquid refrigerant flowing through said helical coil is subcooled and refrigerant vapor within the accumulator is superheated.

7. A heat transfer system according to claim 1, wherein said control means includes:

input means for enabling a user to input a desired pool water temperature set-point and a desired interior space temperature set-point;

a pool water temperature sensor;

an interior space temperature sensor;

a microprocessor means for keeping track of the amount of time said pool water circulating pump has been energized during a twenty-four hour period; wherein, in a first mode of operation said control means energizes said means for compressing, said second heat transfer coil fan, said refrigerant-to-air heat transfer coil fan, and configures said control valve to said first position, when said interior space temperature is higher than the interior space temperature set-point and the pool water temperature is higher than the pool water temperature set-point, whereby said refrigerant-to-air heat transfer coil functions as a condenser such that heat is absorbed from the interior space to the atmosphere;

in a second mode of operation said control means energizes said means for compressing, said evaporator coil fan, configures said control valve to said second position, and energizes the pool water circulating pump, when said interior space temperature exceeds the interior space temperature set-point and said pool water temperature is less than the pool water temperature set-point, whereby said refrigerant-to-water heat exchanger functions as a condenser such that heat is transferred from the interior space to the pool water.

8. A heat pump heat transfer system for heating and cooling an interior space and selectively rejecting heat to one of three alternate heat sinks, said system comprising:

(a) means for compressing refrigerant gas having a suction inlet and a compressed refrigerant gas outlet, said outlet in fluid communication with an oil separator inlet, said oil separator further having a refrigerant outlet and an oil return outlet, said refrigerant outlet in fluid communication with a reversing valve inlet, said reversing valve having first, second and third ports, said reversing valve having a first position wherein communication is realized between said inlet and said third port and separately between said first and second ports, and a second position wherein communication is realized between said inlet and said first port and separately between said second and third ports;

(b) control valve, having an inlet fluidly connected to said reversing valve third port, and first and second outlets, said control valve selectively movable from a first position wherein fluid communication is realized between said control valve inlet and said control valve first outlet, and a second position wherein fluid communication is realized between said control valve inlet and said control valve second outlet;

(c) a first refrigerant-to-air heat transfer coil and a fan for forcing ambient air across said coil, said heat transfer coil having first and second refrigerant ports for passing refrigerant fluid through said coil, said first refrigerant port in fluid communication with said control valve first outlet, and said second refrigerant port communicating with an inlet of a parallel configuration of refrigerant tubing having a first leg including a first check valve and a second leg including a third check valve and a metering device, said parallel tubing configuration having an outlet;

(d) a refrigerant-to-water heat exchanger having a refrigerant inlet and outlet and a water inlet and outlet, said refrigerant inlet in fluid communication with said control valve second outlet and said refrigerant outlet in communication with a second check valve, said water inlet in fluid communication with a water circulating pump for drawing water from a water source, said water outlet being in communication with water conduit for returning water to said water source;

(e) means for receiving refrigerant having an inlet and an outlet, said heat exchanger refrigerant outlet and said parallel tubing configuration outlet each in fluid communication with said inlet of said means for receiving refrigerant, said outlet of said means for receiving refrigerant being in fluid communication with a second parallel configuration of refrigerant tubing having a first leg including metering device and a second leg including a check valve, said second parallel configuration of refrigerant tubing having an outlet;

(f) a second refrigerant-to-air heat transfer coil fluidly connected to said outlet of said second parallel configuration of refrigerant tubing, said second heat transfer coil in heat transfer communication with an interior space for allowing heat transfer between refrigerant in said second heat transfer coil and air from the interior space, said second heat transfer coil having an outlet and a fan for forcing air from the interior space across said second heat transfer coil, said second heat transfer coil outlet fluidly connected to said reversing valve first outlet port;

(g) an accumulator having an inlet fluidly connected to said reversing valve second outlet port, said accumulator inlet further being fluidly connected to said oil separator oil return outlet, said accumulator outlet fluidly connected to said compressor suction inlet;

(h) control means, responsive to interior space temperature and water temperature, for energizing and controlling said system for selectively cooling and heating said interior space and selectively rejecting heat to any one of the atmosphere, the pool water, or the interior space.

9. A heat pump heat transfer system according to claim 8, wherein said refrigerant-to-water heat exchanger comprises a coaxial tube heat exchanger having a corrosion resistant inner tube axially disposed within a tubular outer jacket.

10. A heat pump heat transfer system according to claim 9, wherein said refrigerant-to-water heat exchanger further includes means for by-passing a portion of water from said heat exchanger inlet to said heat exchanger outlet, said means for by-passing including a pressure compensating by-pass valve for compensating for pressure variations in inlet water pressure and maintaining adequate water flow through heat exchanger.

11. A heat pump heat transfer system according to claim 8, wherein said means for receiving refrigerant comprises a liquid receiver.

12. A heat pump heat transfer system according to claim 8, wherein said means for receiving refrigerant includes a suction-liquid heat exchanger.

13. A heat pump heat transfer system according to claim 8, wherein said means for receiving refrigerant includes a helical coil surrounding said accumulator whereby the liquid refrigerant is subcooled and the refrigerant vapor within the accumulator is superheated.

14. A heat pump heat transfer system according to claim 8, wherein said control means includes:

input means for enabling a user to input a desired pool water temperature set-point and a desired interior space temperature set-point;

a pool water temperature sensor;

an interior space temperature sensor;

microprocessor means for keeping track of the amount of time said pool water circulating pump has been energized during a twenty-four hour period; wherein, in a first mode of operation said control means energizes said means for compressing, said evaporator fan, said refrigerant-to-air heat transfer coil fan, and configures said control valve to said first position and configures said reversing valve to said first position, when said interior space temperature is higher than the interior space temperature set-point and the pool water temperature is higher than the pool water temperature set-point, whereby said refrigerant-to-air heat transfer coil functions as a condenser such that heat is transferred from the interior space to the atmosphere;

in a second mode of operation said control means energizes said means for compressing, said evaporator coil fan, configures said control valve to said second position and configures said reversing valve to said first position, and energizes a pool water circulating pump, when said interior space temperature exceeds the interior space temperature set-point and said pool water temperature is less than the pool water temperature set-point, whereby said refrigerant-to-water heat exchanger functions as a condenser such that heat is transferred from the interior space to the pool water;

in a third mode of operation said control means energizes said means for compressing, said evaporator fan, said refrigerant-to-air heat transfer coil fan, and configures said control valve to said first position and configures said reversing valve to said second position, when said interior space temperature is lower than said interior space heating set-point and the pool water temperature is higher than the pool water temperature set-point, whereby said refrigerant-to-air heat transfer coil functions as an evaporator such that heat is transferred from the atmosphere to the interior space.

15. A method of cooling an interior space and selectively rejecting heat to one of two alternate heat sinks, said method practiced using apparatus including control means, means for compressing refrigerant gas, means for separating oil from compressed refrigerant gas, control valve means for selectively diverting compressed refrigerant gas to one of two alternate heat sink condensing means including an atmospheric heat sink and a pool water heat sink, means for receiving condensed liquid refrigerant from each of said two alternate heat sink condensing means, means for evaporating liquid refrigerant in an evaporator, means for mixing evaporated refrigerant with oil separated by said means for separating, means for accumulating oil and evaporated refrigerant, and means for supplying refrigerant gas from said accumulating means to said means for compressing, said method including the steps of:

(a) entering a user selected pool water temperature set-point and a user selected interior space temperature set-point into said control means;

(b) sensing the interior space temperature using an interior space temperature sensor;

(c) sensing pool water temperature using a pool water temperature sensor;

(d) operating in a first operating mode when said sensed interior space temperature is greater than said user selected interior space temperature set-point, and said sensed pool water temperature is greater than said user selected pool water temperature set-point;

said first operating mode including energizing said means for compressing refrigerant gas, and routing said compressed refrigerant gas through said means for separating oil and said control valve means to a heat transfer coil in heat transfer communication with said atmospheric heat sink wherein the refrigerant gas is condensed, routing condensed refrigerant gas to a heat transfer coil in heat transfer communication with said interior space wherein said refrigerant evaporates, mixing said evaporated refrigerant gas with oil from said means for separating oil and supplying a mixture of refrigerant gas and oil to said means for compressing;

(e) operating in a second operating mode when said sensed interior space temperature is greater than said user selected interior space temperature set-point, and said sensed pool water temperature is less than said user selected pool water temperature set-point;

said second operating mode including energizing said means for compressing refrigerant gas, and routing said compressed refrigerant gas through said means for separating oil and said control valve means to a heat transfer coil in heat transfer communication with said pool water wherein the refrigerant gas is condensed, routing condensed refrigerant gas to a heat transfer coil in heat transfer communication with said interior space wherein said refrigerant evaporates, mixing said evaporated refrigerant gas with oil from said means for separating oil and supplying a mixture of refrigerant gas and oil to said means for compressing.

16. A method of selectively cooling and heating an interior space and selectively rejecting heat to one of two alternate heat sinks when cooling said interior space, said method practiced using apparatus including control means, means for compressing refrigerant gas, means for separating oil from compressed refrigerant gas, reversing valve means, control valve means for selectively diverting compressed refrigerant gas to one of two alternate heat sink condensing means including an atmospheric heat sink and a pool water heat sink, means for receiving condensed liquid refrigerant from each of said two alternate heat sink condensing means, means for evaporating liquid refrigerant in an evaporator, means for mixing evaporated refrigerant with oil separated by said means for separating, means for accumulating oil and evaporated refrigerant, and means for supplying refrigerant gas from said accumulating means to said means for compressing, said method including the steps of:

(a) entering a user selected pool water temperature set-point and a user selected interior space temperature set-point into said control means;

(b) sensing the interior space temperature using an interior space temperature sensor;

(c) sensing pool water temperature using a pool water temperature sensor;

(d) operating in a first operating mode when said sensed interior space temperature is greater than said user selected interior space temperature set-point, and said sensed pool water temperature is greater than said user selected pool water temperature set-point;

said first operating mode including energizing said means for compressing refrigerant gas, and routing said compressed refrigerant gas through said means for separating oil, said reversing valve means, and said control valve means to a heat transfer coil in heat transfer communication with said atmospheric heat sink wherein the refrigerant gas is condensed, routing condensed refrigerant gas to a heat transfer coil in heat transfer communication with said interior space wherein said refrigerant evaporates, mixing said evaporated refrigerant gas with oil from said means for separating oil and supplying a mixture of refrigerant gas and oil to said means for compressing;

(e) operating in a second operating mode when said sensed interior space temperature is greater than said user selected interior space temperature set-point, and said sensed pool water temperature is less than said user selected pool water temperature set-point;

said second operating mode including energizing said means for compressing refrigerant gas, and routing said compressed refrigerant gas through said means for separating oil and said reversing valve means, and said control valve means to a heat transfer coil in heat transfer communication with said pool water wherein the refrigerant gas is condensed, routing condensed refrigerant gas to a heat transfer coil in heat transfer communication with said interior space wherein said refrigerant evaporates, mixing said evaporated refrigerant gas with oil from said means for separating oil and supplying a mixture of refrigerant gas and oil to said means for compressing;

(f) operating in a third operating mode when said sensed interior space temperature is less than said user selected interior space temperature set-point, and said sensed pool water temperature is greater than said user selected pool water temperature set-point;

said third operating mode including energizing said means for compressing refrigerant gas, and routing said compressed refrigerant gas through said means for separating oil, and said reversing valve means, to a heat transfer coil in heat transfer communication with said interior space wherein said refrigerant condenses thereby rejecting heat to said interior space, routing said condensed refrigerant gas through said means for receiving to a heat transfer coil in heat transfer communication with said atmospheric heat sink wherein said refrigerant gas evaporates, routing said compressed refrigerant gas through said control valve means and said reversing valve means, and mixing said evaporated refrigerant gas with oil from said means for separating oil and supplying a mixture of refrigerant gas and oil to said means for compressing.

* * * * *